US008833573B2

(12) United States Patent
Tomaszewski et al.

(10) Patent No.: US 8,833,573 B2
(45) Date of Patent: Sep. 16, 2014

(54) DIVIDERLESS PACKAGING SYSTEM FOR SHIPPING AND DISPLAYING PALLETIZED PRODUCTS

(75) Inventors: Valentine Tomaszewski, Western Springs, IL (US); John G. Olmsted, Jr., McKinney, TX (US)

(73) Assignees: Sonoco Development, Inc, Hartsville, SC (US); Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 13/350,913

(22) Filed: Jan. 16, 2012

(65) Prior Publication Data

US 2013/0180941 A1 Jul. 18, 2013

(51) Int. Cl.

| | |
|---|---|
| ***A47F 3/14*** | (2006.01) |
| *A47B 43/00* | (2006.01) |
| *A47B 47/00* | (2006.01) |
| *B65D 21/00* | (2006.01) |
| *B65D 19/00* | (2006.01) |
| *A47B 91/00* | (2006.01) |

(52) U.S. Cl.

USPC ..... 211/126.12; 211/194; 211/135; 206/509; 206/600; 206/821; 108/186

(58) Field of Classification Search

USPC ..... 211/135, 186, 188, 189, 190, 191, 194, 211/126.1, 126.12, 126.2, 126.14, 126.16; 108/180, 186–188, 190, 53.5; 206/509, 206/511, 512, 600, 821, 386; 229/919, 918

See application file for complete search history.

(56) References Cited

U.S. PATENT DOCUMENTS

| | | | | | |
|---|---|---|---|---|---|
| 888,774 | A | * | 5/1908 | Wood | 229/100 |
| 982,538 | A | * | 1/1911 | Senge | 211/126.12 |
| 1,147,975 | A | * | 7/1915 | Ruff | 211/126.12 |
| 1,427,248 | A | * | 8/1922 | Weston | 211/85.17 |
| 1,428,730 | A | * | 9/1922 | Weston | 108/1 |
| 1,435,346 | A | * | 11/1922 | Stoll | 126/38 |
| 1,957,153 | A | * | 5/1934 | Smiley, Jr. | 211/126.12 |
| 2,047,093 | A | * | 7/1936 | Barbee | 312/3 |
| 2,235,709 | A | * | 3/1941 | Hearn et al. | 206/449 |
| 2,376,660 | A | * | 5/1945 | Clark | 229/199 |
| 2,941,710 | A | * | 6/1960 | Smith et al. | 229/199 |
| 3,062,335 | A | * | 11/1962 | Baxter | 52/222 |
| 3,073,500 | A | * | 1/1963 | Goodrich et al. | 206/447 |
| 3,129,868 | A | * | 4/1964 | Jenk | 206/586 |
| 3,313,248 | A | * | 4/1967 | Bayluk | 108/53.5 |
| RE26,481 | E | * | 10/1968 | Evans | 108/53.5 |
| RE27,200 | E | * | 10/1971 | Ferdinand et al. | 211/190 |
| 3,834,324 | A | * | 9/1974 | Lang | 108/91 |
| 3,850,295 | A | * | 11/1974 | Black | 206/304 |
| 3,855,944 | A | * | 12/1974 | Skubic et al. | 108/53.5 |

(Continued)

*Primary Examiner* — Joshua J Michener
*Assistant Examiner* — Devin Barnett
(74) *Attorney, Agent, or Firm* — Miller, Matthias & Hull LLP

(57) ABSTRACT

A modular packaging system for shipping and displaying palletized products is provided. The packaging system comprises a plurality of vertically stacked trays for holding the products, corner posts extending between vertically adjacent trays for spacing and supporting the trays, and one or more separate elongated braces located under and supporting one or more of the trays. The ends of the braces extend into openings in the corner posts. The system is strong enough not only to support the weight of the products on the trays and withstand the vibration and impact forces that can occur during shipping, but to withstand the weight of one or more units stacked on top.

8 Claims, 8 Drawing Sheets

(56) References Cited

U.S. PATENT DOCUMENTS

| | | | | | |
|---|---|---|---|---|---|
| 3,887,288 | A * | 6/1975 | Glaser | 403/219 |
| 3,994,241 | A * | 11/1976 | Evans | 108/53.5 |
| 4,053,098 | A * | 10/1977 | Baptist | 206/509 |
| 4,182,244 | A * | 1/1980 | Hutchins et al. | 108/91 |
| 4,231,299 | A * | 11/1980 | Gebhardt et al. | 108/91 |
| 4,341,338 | A * | 7/1982 | Arnold | 229/122.21 |
| 4,351,246 | A * | 9/1982 | Hutchins, Jr. | 108/156 |
| 4,356,952 | A * | 11/1982 | Rekow | 206/511 |
| 4,433,788 | A * | 2/1984 | Erlam et al. | 211/26 |
| 4,579,233 | A | 4/1986 | Hepp | |
| 4,613,045 | A * | 9/1986 | Watson | 206/512 |
| 4,638,941 | A * | 1/1987 | Watson | 229/104 |
| 4,901,872 | A * | 2/1990 | Lang | 211/126.12 |
| 4,905,834 | A * | 3/1990 | Mur Gimeno et al. | 206/512 |
| 4,911,303 | A * | 3/1990 | Andersson | 206/509 |
| 5,037,027 | A * | 8/1991 | Nichols | 229/198.1 |
| D328,535 | S * | 8/1992 | Dupre et al. | D6/475 |
| 5,269,112 | A * | 12/1993 | Weinrub et al. | 52/646 |
| 5,277,310 | A * | 1/1994 | Mertz | 206/320 |
| 5,291,838 | A * | 3/1994 | Ferchau et al. | 108/180 |
| 5,295,632 | A * | 3/1994 | Zink et al. | 229/198 |
| D359,180 | S * | 6/1995 | Bedney | D6/475 |
| 5,499,883 | A * | 3/1996 | Heinzel | 403/219 |
| 5,918,751 | A * | 7/1999 | Kelly | 211/194 |
| 6,012,581 | A * | 1/2000 | Galazzo | 206/499 |
| 6,036,034 | A * | 3/2000 | Battaglia et al. | 211/187 |
| 6,311,856 | B2 * | 11/2001 | Battaglia et al. | 211/187 |
| 6,349,877 | B1 * | 2/2002 | Bradford | 229/198.1 |
| 6,378,764 | B1 * | 4/2002 | Teixidor Casanovas | 229/191 |
| 6,547,127 | B2 * | 4/2003 | Bradford et al. | 229/199 |
| 6,564,993 | B1 * | 5/2003 | Wassink | 229/199 |
| 6,592,025 | B2 * | 7/2003 | Bazany et al. | 229/199 |
| 6,749,108 | B2 * | 6/2004 | Naughton et al. | 229/199 |
| 7,066,342 | B2 * | 6/2006 | Baechle et al. | 211/191 |
| 7,118,023 | B2 * | 10/2006 | Holdsworth | 229/164 |
| 7,124,695 | B2 * | 10/2006 | Buechler | 108/180 |
| 7,137,517 | B2 * | 11/2006 | Lowry et al. | 211/188 |
| 7,281,648 | B2 * | 10/2007 | Lowry | 229/199 |
| 7,637,372 | B2 | 12/2009 | Keel et al. | |
| 7,770,342 | B2 * | 8/2010 | Marschke | 52/223.1 |
| 8,276,753 | B2 * | 10/2012 | Garcia De Alba | 206/386 |
| 8,376,157 | B2 * | 2/2013 | Jarvis et al. | 211/187 |
| 2002/0139766 | A1 * | 10/2002 | Courtwright | 211/191 |
| 2002/0195410 | A1 * | 12/2002 | Lin | 211/190 |
| 2003/0173321 | A1 * | 9/2003 | Craft et al. | 211/144 |
| 2004/0060835 | A1 * | 4/2004 | Gits | 206/319 |
| 2004/0084514 | A1 * | 5/2004 | Casanovas | 229/117.07 |
| 2005/0109826 | A1 * | 5/2005 | Fry et al. | 229/178 |
| 2005/0145687 | A1 * | 7/2005 | Conway | 229/174 |
| 2006/0091194 | A1 * | 5/2006 | Fry | 229/174 |
| 2006/0108408 | A1 * | 5/2006 | Lowry | 229/199 |
| 2006/0175227 | A1 * | 8/2006 | Lau | 206/600 |
| 2006/0249565 | A1 * | 11/2006 | Wood et al. | 229/164 |
| 2007/0017843 | A1 * | 1/2007 | Keel et al. | 206/509 |
| 2007/0108147 | A1 * | 5/2007 | Chen | 211/187 |
| 2009/0032432 | A1 * | 2/2009 | Kostos et al. | 206/600 |
| 2011/0220544 | A1 * | 9/2011 | De Alba | 206/600 |
| 2013/0026060 | A1 * | 1/2013 | Moss | 206/512 |

* cited by examiner

DIVIDERLESS PACKAGING SYSTEM FOR SHIPPING AND DISPLAYING PALLETIZED PRODUCTS

BACKGROUND

1. Field of the Invention

This patent relates to a tray and post type packaging system for shipping and displaying palletized products. More particularly, this patent relates to a dividerless tray and post type packaging system in which the trays are reinforced with separate brace members.

2. Description of the Related Art

Palletized packaging systems suitable for both shipping products and displaying them at retail are well known. For example, Sonoco Products Company makes a tray and post type packaging system that is described in co-owned U.S. Pat. No. 7,066,342, incorporated herein by reference. The products in their primary packages (what the consumer actually buys) are arranged on the trays. The entire unit is self-supporting and may be displayed in the store aisle.

There are two general types of palletized packaging systems: those in which the trays are supported by the products themselves, and those in which the trays are supported wholly or partly by structural components, such as corner posts, partitions and dividers. The use of dividers between each tray can improve stacking strength, but can make it difficult for consumers to view the products.

The objective of the present invention is to provide a palletized packaging system for the shipping and display of products that has increased stacking strength and enhanced product visibility.

Another objective of the present invention is to provide a packaging system that eliminates dividers by reinforcing the trays with separate brace members.

Further and additional objects will appear from the description, accompanying drawings, and appended claims.

SUMMARY OF THE INVENTION

The present invention is a modular packaging system for shipping and displaying palletized products. The system comprises vertically stacked trays for holding the products, corner posts affixed to each tray, and separate braces that support the bottoms of each tray. The entire assembly may be wrapped in transparent plastic film to protect the products from dust and damage with the bottom tray resting on a standard pallet.

Each tray may comprise a bottom panel for holding the products, two opposing side walls and two opposing end walls extending upwardly from the bottom panel. The corner posts extend between vertically adjacent trays to separate and support the trays. In a key aspect of the invention at least one separate elongated brace is located under and supports (contacts) the bottom panel of one or more of the trays. The brace extends horizontally between two corner posts and has opposing ends that fit into notches or other openings in the two corner posts.

The brace may be any suitable shape, such as one having an "I" shaped cross sectional profile with two elongated substantially rectangular sides and relatively narrower top and bottom edges where the dimension from top edge to bottom edge is greater than the dimension from side to side. Preferably the brace is oriented vertically, that is, with its sides defining parallel vertical planes, for maximum load bearing strength.

Each corner post may further comprise one or more tabs extending upward from a top edge of the corner post and extending through slots disposed in the bottom panel of the tray resting on the corner posts to lock vertically adjacent tray levels together. Each corner post may also comprise two wings (tab-like members) that extend outwardly from a lower portion of the corner post at a right angle to each other. One wing may be enclosed by a tray end wall and the other wing enclosed by a tray side wall to secure the corner post to the tray on which it rests.

The braces may extend between diagonally opposed corner posts and/or along the perimeter (ends and sides) between adjacent corner posts. In a packaging system having multiple tray levels, diagonal braces located under and supporting vertically adjacent trays may define intersecting planes. That is, the diagonal brace under one tray may extend along one diagonal when viewed from above while the brace under the vertically adjacent tray extends along the other diagonal so that, when viewed from above, the diagonal braces cross or intersect.

For maximum reinforcement the packaging system may further comprise a central vertical post extending from a center of a tray bottom panel to a height equal to that of the corner posts on the same tray, and one or two "half diagonal" braces, each extending from a corner post to the central vertical post.

Each corner post may be made from a single, unitary folded blank so that the assembled corner posts have a substantially rectangular cross section comprising two orthogonal outer walls joined along an outer vertical edge and two orthogonal inner walls joined along an inner vertical edge to define a substantially hollow interior. Each corner post has a top edge that abuts the tray resting on top and a bottom edge that rests on the tray below.

A notch may be located along the inner vertical edge of the corner post and communicates with the top edge to accommodate the end of a diagonal brace. Each corner post may further comprise "perimeter notches" disposed in the inner walls and communicating with the top edge to accommodate the perimeter braces, if present.

The bottommost tray may be disposed on a pallet and a top cap may be placed over the topmost tray and rest on a topmost set of corner posts. The trays and corner posts may be formed of corrugated board and the braces may be wound hollow paper tubes.

The system is strong enough not only to support the weight of the products on the trays and withstand the vibration and impact forces that can occur during shipping, but to withstand the weight of one or more units stacked on top. The system is particularly suited for shipping and displaying irregularly shaped items and items that cannot withstand vertical stacking forces, such as soft-packaged goods, since the system can bear the entire stacking load.

THE DRAWINGS

DETAILED DESCRIPTION OF THE INVENTION

Figure 1:
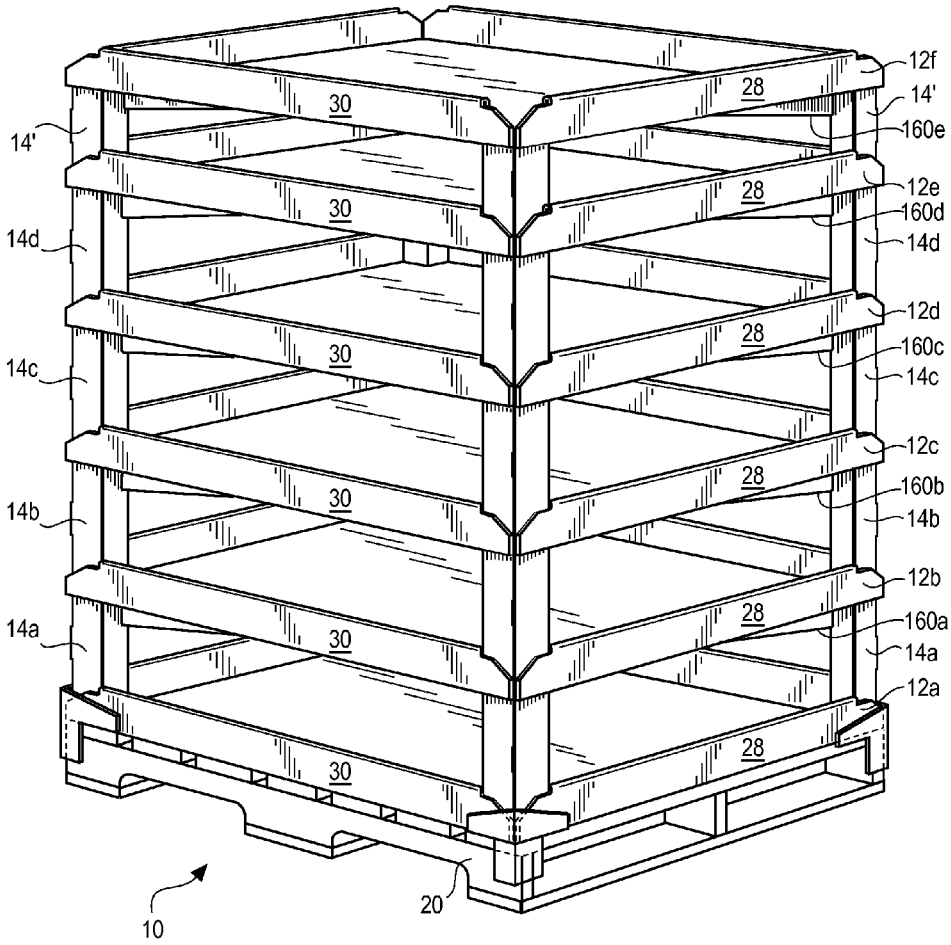
FIG. 1 is a perspective view of one embodiment of a packaging system according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Packaging System with Reinforced Trays

Turning to the drawings, there is shown in FIG. 1 one embodiment of the present invention, a tray and post type packaging system 10 for shipping and displaying retail products. The packaging system 10 comprises a plurality of trays 12 for holding products in their primary packaging, corner posts 14 that separate and support the trays 12, and (optionally) a top cap (not shown). The packaging system 10 may be wrapped in an outer wrap (not shown) to protect the products from dust and damage during shipment and carried on a standard pallet 20.

Each tray 12 preferably is formed from folded blank 24 of corrugated board, although any suitable material may be used. Each tray 12 has a bottom panel 26 for supporting the products, two opposing side walls 28 and two opposing end walls 30 extending upwardly from the bottom panel 26. The side walls 28 and end walls 30 capture portions of the corner posts 14 as described below. The bottom panel 26 and/or side walls 28 and/or end walls 30 may be printed or otherwise decorated in any desirable fashion to increase the aesthetic appeal of the display.

The corner posts 14 space the trays 12 apart and provide a platform on which each tray 12 can rest. The height of the corner posts 14 is determined by the height of the products in their primary packaging or, more particularly, the desired height between trays 12.

In a key aspect of the invention, braces 160 are used to support the underside of each tray 12. As explained in more detail below the braces may extend between diagonally opposed corner posts 14 (as shown in FIG. 1) and/or between adjacent corner posts 14 (i.e., corner posts located along a common end or side), and may be captured within notches or other openings formed in the corner posts 14.

Tray Blank

Figure 2:
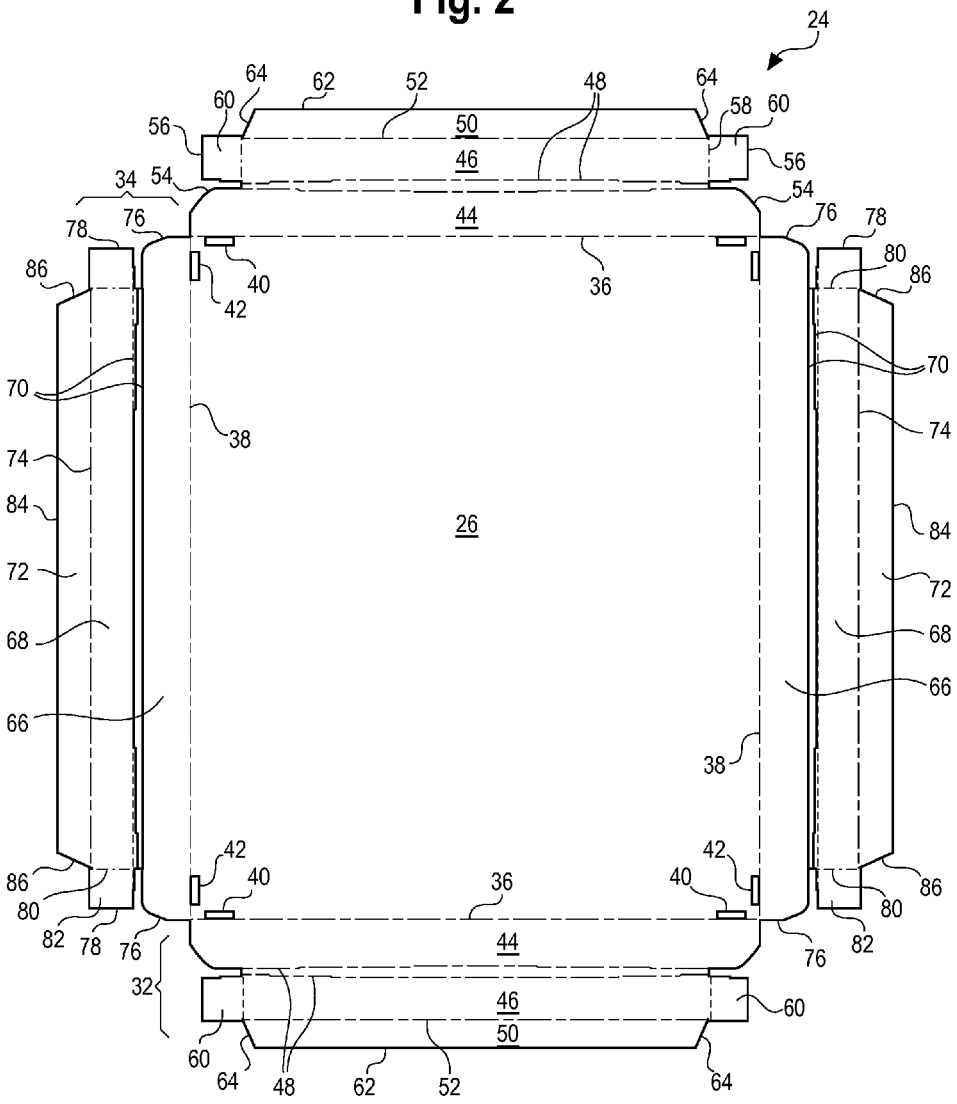
FIG. 2 is a top plan view of a blank used to form the trays of the packaging system of FIG. 1.

Each tray 12 can be made from a single, unitary (one piece) corrugated blank 24 such as that shown in FIG. 2. The blank 24 may be made from any suitable material, but corrugated board is preferred for its combination of strength, light weight and recyclability. The blank 24 is shown cut and scored from a single piece of corrugated board to the desired shape, and comprises a rectangular bottom or main panel 26, two opposing side wall assemblies 32 and two opposing end wall assemblies 34. The rectangular bottom panel 26 is defined by parallel, opposing first side fold lines 36 and parallel, opposing first end fold lines 38. A slot 40 is disposed in the bottom panel 26 adjacent each first side fold line 36 near each opposing corner. Likewise, a slot 42 is disposed in the bottom panel 26 adjacent each first end fold line 38 near each opposing corner.

Each side wall assembly 32 extends outward from the bottom panel 26 along the first side fold line 36. Each side wall assembly 32 comprises an elongated, substantially rectangular exterior side panel 44—so called because it forms the exterior of the side wall 28 in the assembled tray 12—attached to the bottom panel 26 along the first side fold line 36; an elongated, substantially rectangular interior side panel 46 connected to the exterior side panel 44 along parallel double side fold lines 48; and a side panel extension 50 connected to the interior side panel 46 along a third side fold line 52.

Each exterior side panel 44 is defined by relatively long side fold lines 36, 48 and relatively short first free side edges 54. The free side edges 54 may be non-linear as shown in FIG. 2.

Each interior side panel 46 is defined by relatively long side fold lines 48, 52 and relatively short opposing second free edges 56. Optional opposing fold lines 58, when present, help define rectangular shaped flaps 60.

The side panel extension 50 may be trapezoid shaped and is defined by the third side fold line 52 (as the base or longest side), an opposing substantially parallel free edge 62, and two relatively shorter angled side edges 64. Each angled side edges 64 defines a free edge and forms an included angle of about 45 degrees with the base or third fold line 52.

Each end wall assembly 34 extends outward from the bottom panel 26 along a first end fold line 38 and may be of similar construction as the side panel assemblies 32. Each end wall assembly 34 comprises an elongated, substantially rectangular exterior end panel 66—so called because it forms the exterior of the end wall 30 in the assembled tray 12—attached to the bottom panel 26 along the first end fold line 38, an elongated substantially rectangular interior end panel 68 connected to the exterior end panel 66 along parallel double end fold lines 70, and an end panel extension 72 connected to the interior end panel 68 along a third end fold line.

Each exterior end panel 66 is defined by the relatively long end fold lines 38, 70 and relatively short first free side edges 76. The free side edges 76 may be non-linear as shown in FIG. 2.

Each interior end panel 68 is defined by relatively long side fold lines 70, 74 and relatively short opposing second free edges 78. Optional opposing fold lines 80, when present, help define rectangular shaped flaps 82.

The end panel extension 50 may be trapezoid shaped and is defined by the third end fold line 74 (as the base or longest side), an opposing substantially parallel free edge 84, and two relatively shorter angled edges 86. Each angled edge 86 defines a free edge and forms an included angle of about 45 degrees with the base or third fold line 74.

Corner Post Blank

Figure 3:
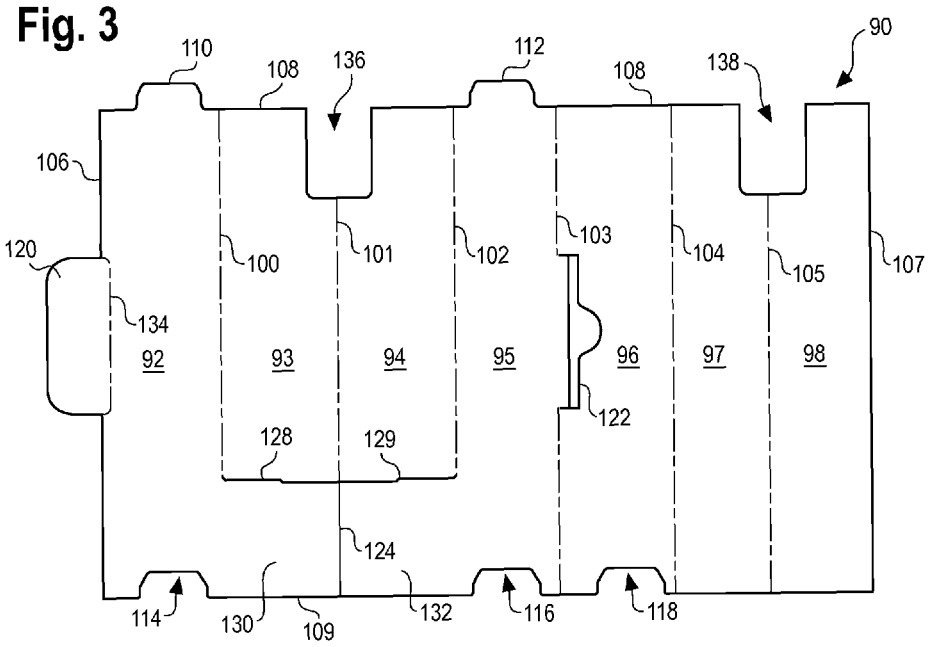
FIG. 3 is a top plan view of a blank used to form the corner posts of the packaging system of FIG. 1.

Each corner post 14 may be made from a single, unitary (one piece) corrugated blank 90 such as that shown in FIG. 3. The blank 90 may be made from any suitable material, but corrugated board is preferred for its combination of strength, light weight and recyclability. The blank 90 is shown cut and scored from a single piece of corrugated board to the desired shape, one having a substantially rectangular configuration with opposing side edges 106, 107 and opposing top and bottom edges 108, 109. The blank 90 generally comprises a plurality of generally rectangular panels 92, 93, 94, 95, 96, 97 and 98 divided from each other by fold lines 100, 101, 102, 103, 104 and 105. Panels 92 and 95 are generally L-shaped, and include tab-like wings 130, 132 respectively, the purpose of which is explained below.

Tabs 110, 112 extend upwardly from panels 92 and 95 respectively and are configured to fit into corresponding slots in the tray 12 above. Bottom notches 114, 116 and 118 are cut into the bottom portions of panels 92, 95 and 96 respectively to accommodate the tabs 110, 112 of the corner post 14 located on the tray below. A locking tab 120 extends laterally (horizontally) from panel 92 along a fold line 134 co-linear with the free edge 106 and is configured to fit into a vertical slot 122 located in panel 96 adjacent fold line 103.

Vertical cut line 124, co-linear with fold line 101, and horizontal cut lines 128 and 129 facilitate folding the blank 90 and help define wings 130, 132 which help secure the corner post 14 to the tray 12 as explained below. Additional cut outs 136 and 138 are formed along the free top edge 108 of the blank 90 and are used to hold diagonal braces 160 as explained below.

Corner Post Blank—Alternative Embodiment

Figure 4:
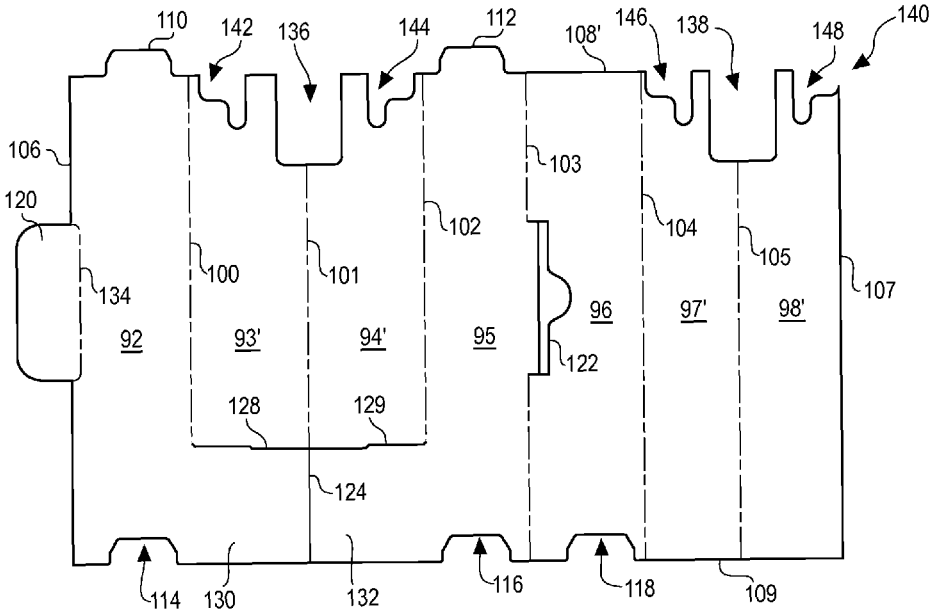
FIG. 4 is a top plan view of a blank used to form an alternative corner post according to the present invention.

A single, unitary (one piece) blank 140 for making an alternative corner post 16 is shown in FIG. 4. The alternative corner post 16 is substantially similar to the previous corner post 14 but incorporates additional cut outs or notches 142, 144, 146, 148 along its top edge to accommodate additional braces.

As with the blank of FIG. 3, the blank 140 may be made from any suitable material, but corrugated board is preferred for its combination of strength, light weight and recyclability. The blank 140 is shown cut and scored from a single piece of corrugated board to the desired shape, one having a substantially rectangular configuration with opposing side edges 106, 107 and opposing top and bottom edges 108, 109. The blank 90 generally comprises a plurality of panels 92, 93', 94', 95, 96', 97' and 98' divided from each other by fold lines 100, 101, 102, 103, 104 and 105. Panels 93', 94', 96, 97' and 98' are generally rectangular. Panels 92 and 95 are generally L-shaped, and include wings 130, 132 respectively.

Tabs 110, 112 extend upwardly from panels 92 and 95 respectively and are configured to fit into corresponding slots in the tray 12 above. Bottom notches 114, 116 and 118 are cut into the bottom portions of panels 92, 95 and 96 respectively to accommodate the tabs 110, 112 of the corner post 14 located on the tray below. A locking tab 120 extends laterally from panel 92 along a fold line 134 co-linear with the free edge 106 and is configured to fit into a vertical slot 122 located in panel 96 adjacent fold line 103.

Vertical cut line 124, co-linear with fold line 101, and horizontal cut lines 128 and 129 facilitate folding the blank 140 and help define wings 130, 132 which help secure the corner post 16 to the tray 12 as explained below. Cut outs 136 and 138 are formed along the free top edge 108 of the blank 90 and are used to hold the braces as explained below.

In a change from the embodiment shown in FIG. 3, the blank 140 shown in FIG. 4 comprises additional cut out portions 142, 144, 146, 148 disposed along the top edge 108' for accommodating additional reinforcing posts as explained below.

Corner Post Assembly

Figure 5A:
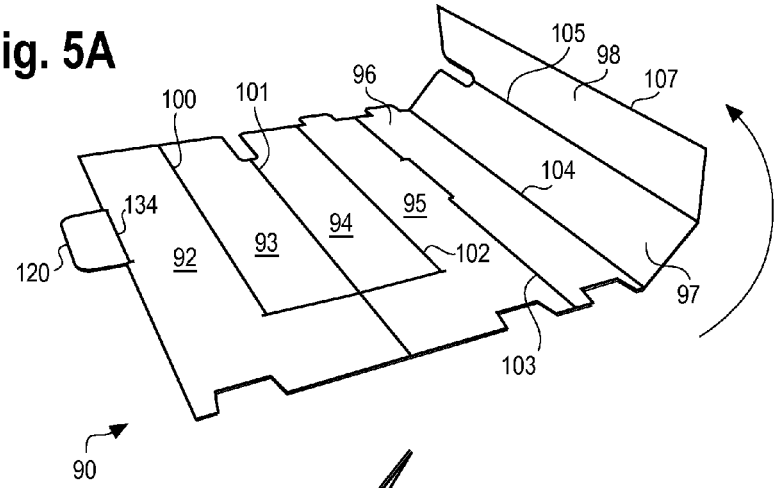
FIGS. 5A, 5B and 5C are perspective views of a corner post shown in varying stages of assembly.
Figure 5B:
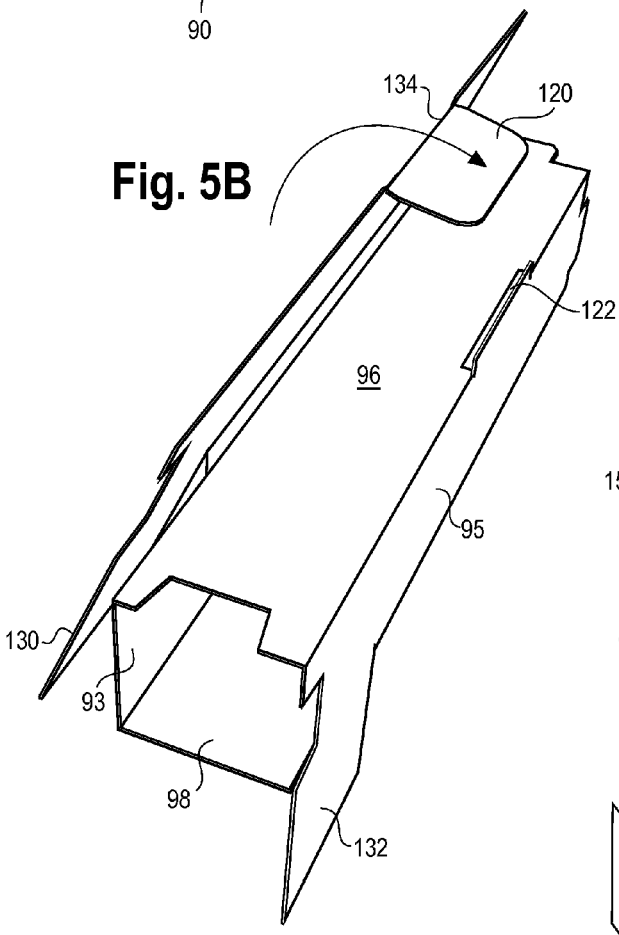
Figure 5C:
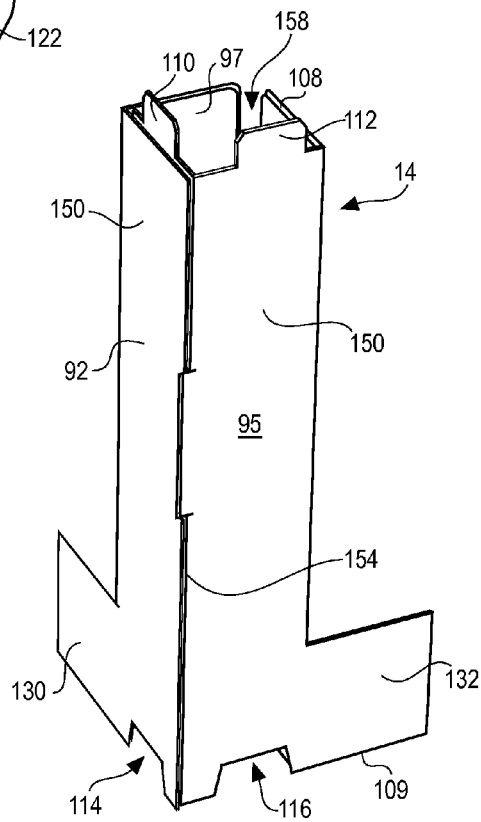

Both corner post embodiments 14, 16 are assembled in the same manner, as will now explained with regard to the first embodiment 14. The corner post 14 may be assembled from the blank 90 of FIG. 3 by first folding the blank 90 along fold lines 100, 101, 102, 103, 104 and 105 as shown in FIG. 5A until a rectangular cylinder is formed. The rectangular cylinder will have three walls having a double thickness (of corrugated) and one wall having a single thickness. As panel 92 is being folded over the tab 120 can be folded along fold line 134 and guided into the vertical slot 122 as shown in FIG. 5B to hold the partially assembled post in a cylindrical configuration. In the finished corner posts 14 shown in FIG. 5C the wings 130, 132 will extend outwardly at a right angle to each other.

The assembled corner post 14 comprises two orthogonal outer walls 150 joined along an outer corner or vertical edge 154 and two orthogonal inner walls 152 joined along an inner corner or vertical edge 156 and has a substantially hollow interior. The corner post 14 has a planar top edge 108 that abuts a tray 12 resting on top and a planar bottom edge 109 that rests on a tray 12 in the assembled packaging system 10. The notches 136, 138 align to form a top notch 158 located along the inner vertical edge 156 (see, especially, FIG. 6C) of the corner post 14 and communicating with the top edge 108. The width of the top notch 158 should be sized to hold a brace 160. Bottom notches 114, 116 disposed in the outer walls 150 extend upwardly from the bottom edge 109 of the corner posts to accommodate the tabs 110, 112 of a corner post 14 located on the tray 12 below.

With respect to the alternative embodiment corner post 16, after assembly, that is, after the blank 140 of FIG. 4 is folded in the same manner as described above with respect to the blank 90 of FIG. 3, the assembled corner post 16 comprises two orthogonal outer walls 150 joined along an outer corner or vertical edge 154 and two orthogonal inner walls 176 joined along an inner corner or vertical edge 156 and has a substantially hollow interior. The corner post 16 has a top edge 108' and a bottom edge 109 that rests on a tray 12 in the assembled packaging system. The notches 136, 138 align to form a top notch 158 located along the inner vertical edge 156 of the corner post 16 and communicating with the top edge 108'. Bottom notches 114, 116 disposed in the outer walls 150 extend upwardly from the bottom edge 109 of the corner posts 16 to accommodate the tabs 110, 112 of a corner post 16 located on the tray 12 below.

Figure 10:
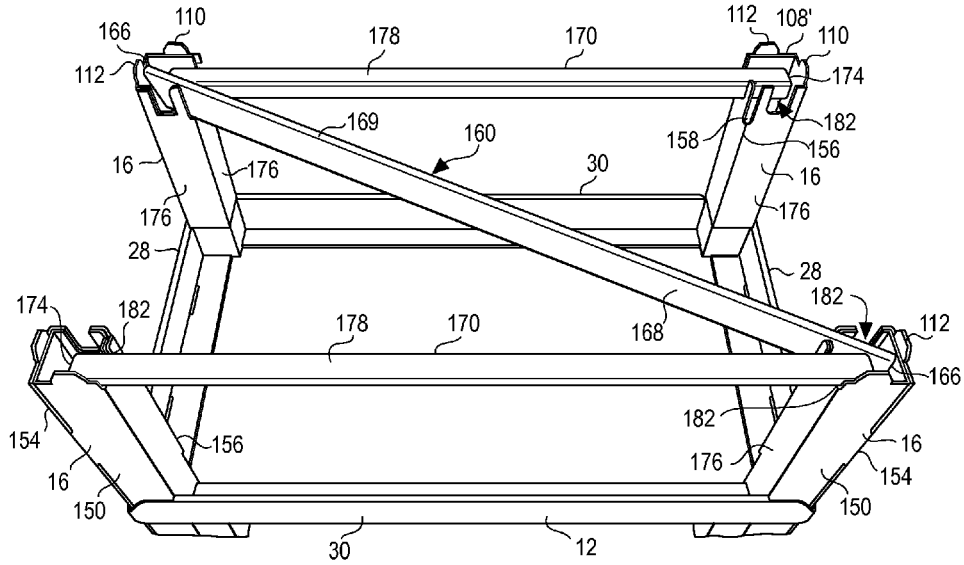
FIG. 10 is a partial perspective view of a second embodiment of a packaging system according to the present invention.
Figure 11:
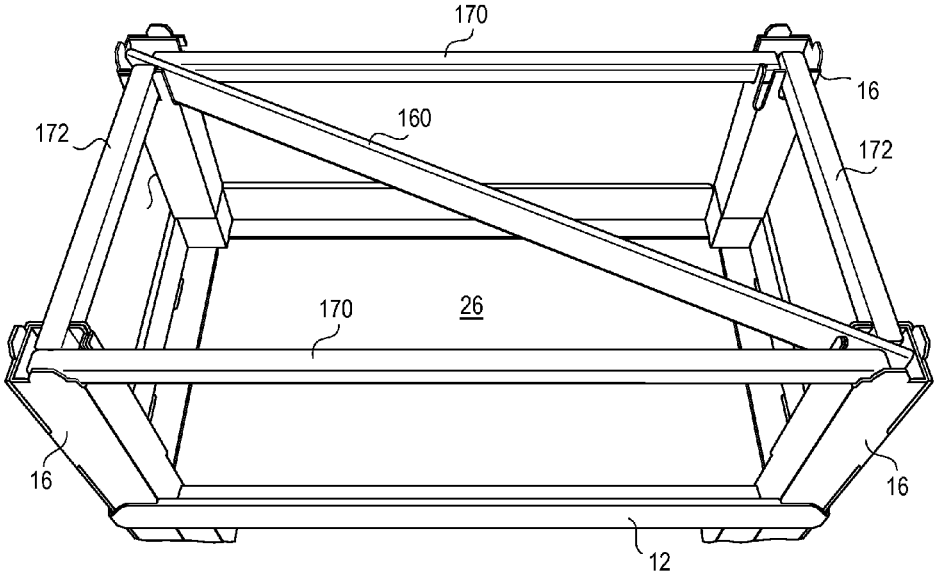
FIG. 11 is a partial perspective view of a third embodiment of a packaging system according to the present invention.
Figure 12:
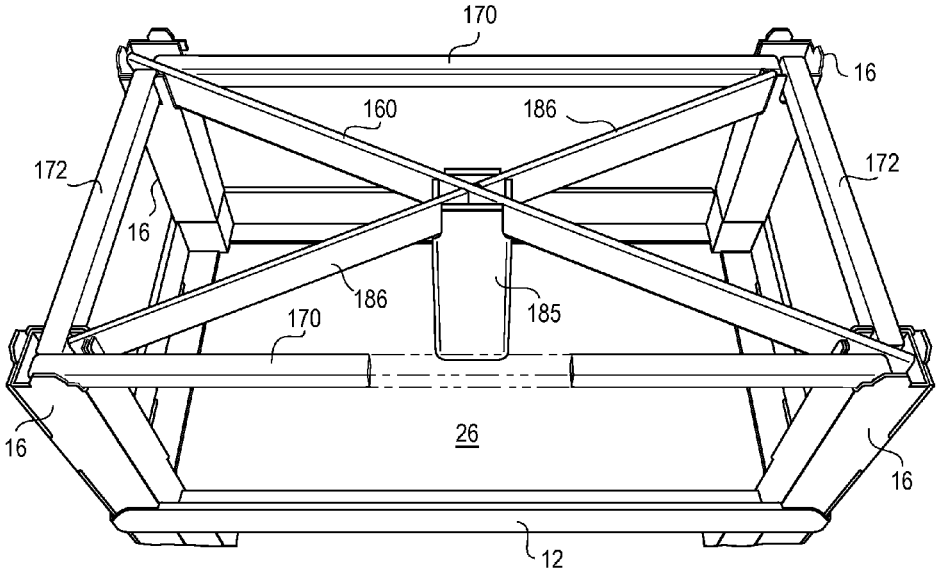
FIG. 12 is a partial perspective view of a fourth embodiment of a packaging system according to the present invention.

When the blank 140 is folded notches 142, 144, 146 and 148 align to form two perimeter notches 182 which are designed to accommodate the perimeter braces 170, 172 as shown in FIGS. 10-12. The two perimeter notches 182 are disposed in the inner walls 176 and communicating with (extending downward from) the top edge 108'.

The corner posts 14, 16 may be made to any suitable height, which may be a function of the height of the products carried on the trays 12. Different levels may have different heights for example, to accommodate products of varying heights shipped and displayed in the same packaging system 10.

Non-Corrugated Corner Posts

While the corner posts 14, 16 have been described as being made from corrugated blanks 90, 140, it should be understood that the corner posts may also be made from any suitable material, including without limitation paper, plastic, metal or wood. The corner posts must have notches or other openings to hold the ends 166 of a brace 160 as explained below.

Tray Assembly

Each tray 12 may be assembled from the blank 24 of FIG. 2 in the following manner. The side walls 28 are formed by first folding each side wall assembly 32 inwardly along the first side fold line 36 until they are substantially perpendicular to the bottom panel 26. Then the side panel extensions 50 are folded backward (away from the bottom panel 26) along the third side fold lines 52 until they are horizontal (at right angles to the exterior side panels 44). The interior side panels 46 are folded inwardly along the double side fold lines 48 until the interior side panels 46 are in facing, abutting relationship with the exterior side panels 44 and the side panel extensions 52 are in facing, abutting relationship with the tray bottom panel 26.

The end walls 34 are assembled in a similar manner by first folding each end wall assembly 34 inwardly along the first end fold line 38 until they are substantially perpendicular to the bottom panel 26. Then the end panel extensions 72 are folded backward (away from the bottom panel 26) along the third end fold lines 74 until they are horizontal (at right angles to the exterior end panels 66). The interior end panels 68 are folded inwardly along the double end fold lines 70 until the interior end panels 68 are in facing, abutting relationship with the exterior end panels 66 and the end panel extensions 72 are in facing, abutting relationship with the tray bottom panel 26.

The assembled tray 12 forms a lightweight, rigid shelf that may be reinforced from underneath for certain loads as explained below.

Packaging System Assembly

Figure 6A:
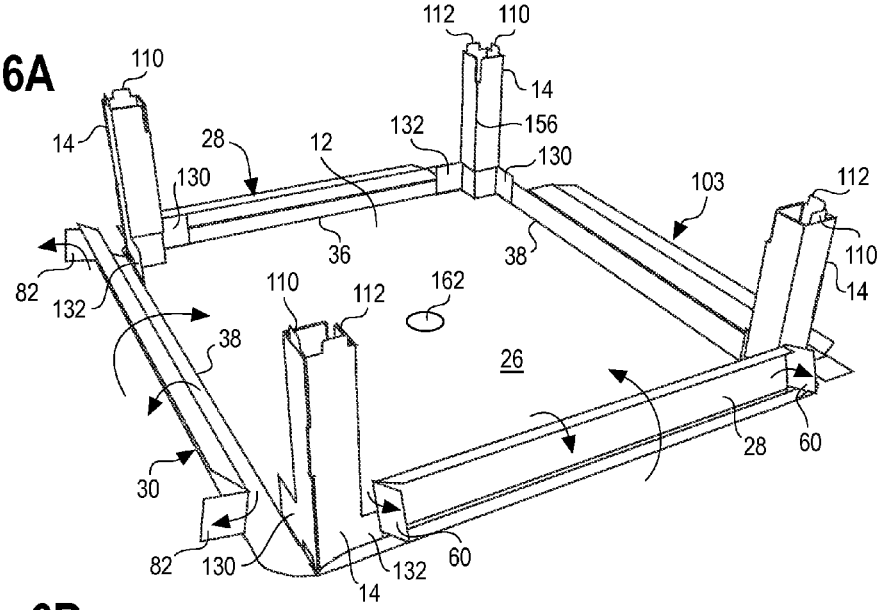
FIGS. 6A, 6B and 6C are perspective views of a tray and four corner posts shown in varying stages of assembly.

Each level of the packaging system 10 of FIG. 1 may be fabricated as follows. After assembling four corner posts 14 as described above, the corner posts 14 are placed onto the four corners of a flat tray blank 90 with the bottom of the corner post resting on the bottom panel 26 and the corner post outer walls 150 aligned with the edges 36, 38 of the bottom panel 26 as shown in FIG. 6A. The corner post tabs 110, 112 will be pointed up and the wings 130, 132 will be extending outward from a lower portion of the corner post 14. The small flaps 60, 82 in each tray corner should be back-folded as indicated by the arrows in FIG. 6A to facilitate assembly of the side walls 28 and end walls 30.

Figure 6B:
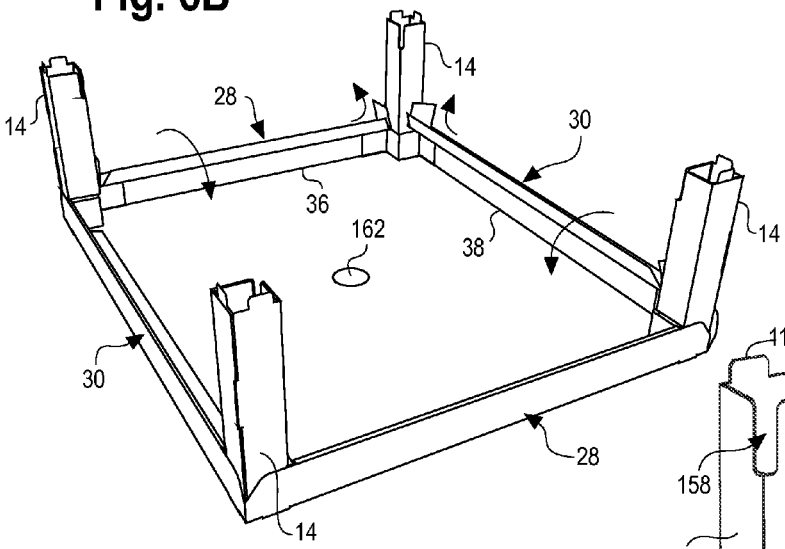
Figure 6C:
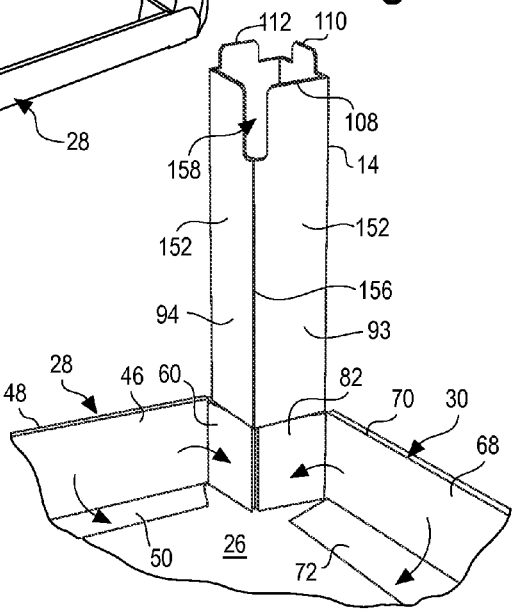

As the tray side walls 28 and end walls 30 are assembled as explained above they will capture (enclose) the corner post wings 130, 132 to secure the corner post 14 to the tray 12 as shown in FIG. 6B. The side walls 28 and end walls 30 may be glued or otherwise affixed to the tray bottom panel 26. The small flaps 60, 82 should "snap" underneath the bottom of the corner post panels 93, 94 and abut panels 97, 98 (part of the inner walls 152) of each corner post 14 as shown in FIG. 6C.

Figure 7:
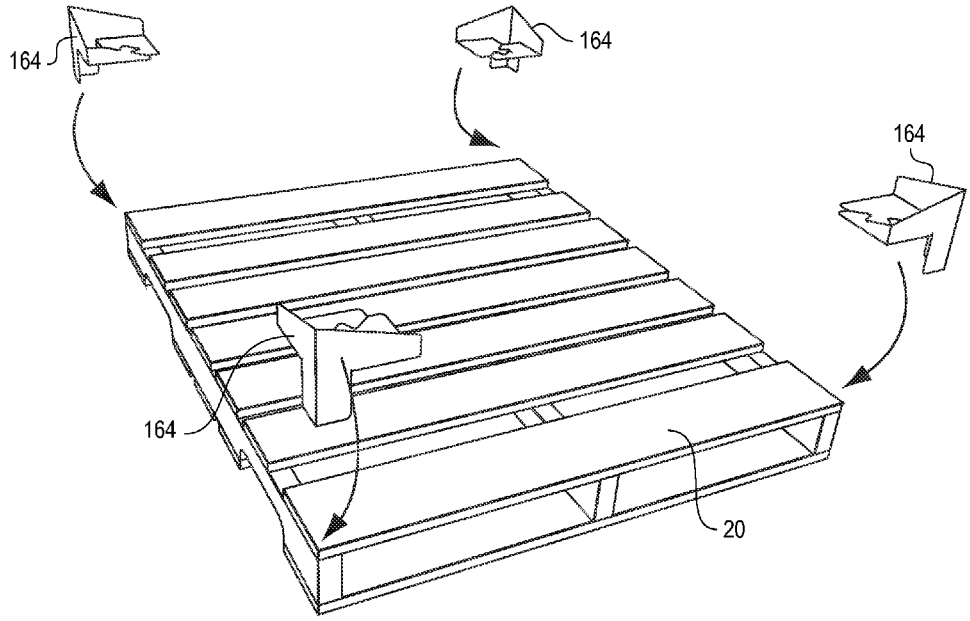
FIG. 7 is a perspective view of a pallet and corner mounts.
Figure 8:
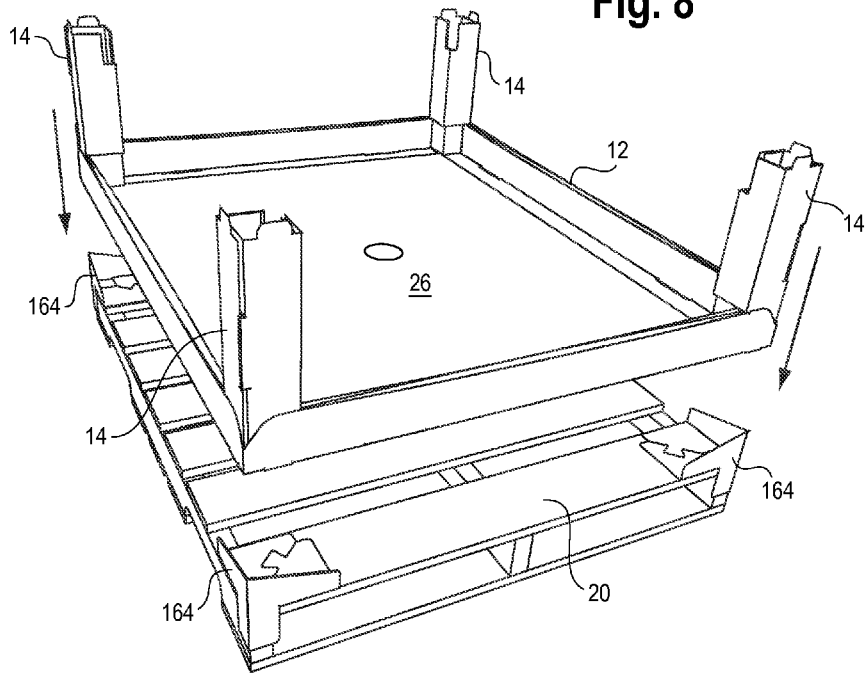
FIG. 8 is a perspective view of a pallet and first (bottom) tray shown prior to placing the first tray onto the pallet.

Corner mounts 164 may be installed at the four corners of a conventional wood pallet 20 as shown in FIG. 7. Then the tray and post assembly of FIG. 6C can be positioned onto the pallet 20 using the corner mounts 164 as a guide as shown in FIG. 8.

When a second tray and corner post assembly is placed on top of the first assembly the upwardly extending tabs 110, 112 will fit through corresponding slots 40, 42 located in the second (upper) tray 12 and into the bottom notches 114 of the corner post 14 above to help hold the two trays 12 in vertical alignment. Additional tray and post layers may be placed on top until the assembled unit has the desired numbers of layers.

Braces

While the packaging system just described is suitable for some applications, in other applications it is desirable to reinforce the trays 12 with horizontal braces. Various reinforcing configurations may be employed, including the following.

Packaging System Assembly—First Embodiment

Figure 9:
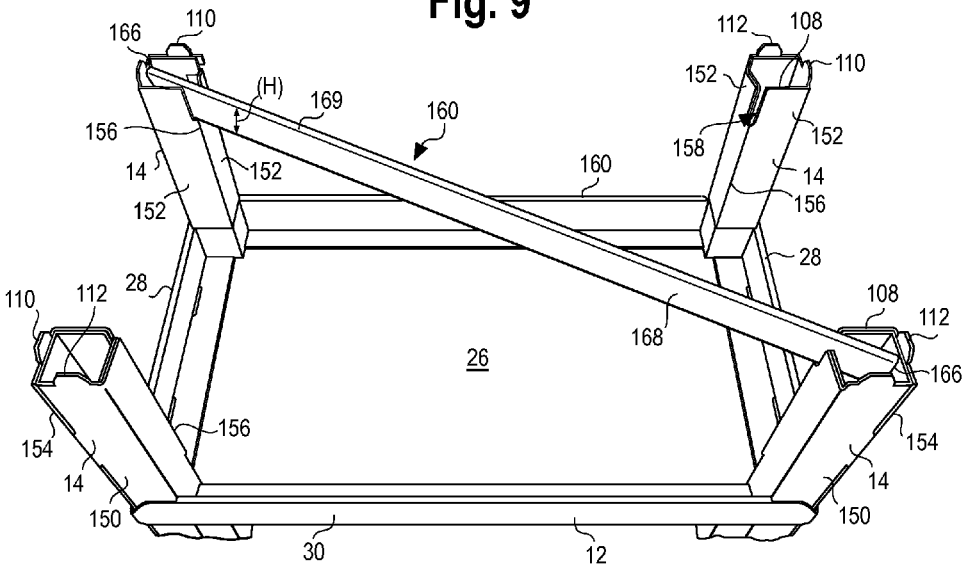
FIG. 9 is a partial perspective view of a first embodiment of a packaging system according to the present invention.

During assembly of the packaging system 10 a single diagonal brace 160 may be placed onto diagonally opposed corner posts 14 by guiding its ends 166 into the top notches 158. The ends 166 should extend into the hollow interior spaces of the corner posts 14 as shown in FIG. 9. The upper edge 169 of the brace 160 should be aligned with the top edge 108 of the corner posts 14 so that if a second tray 12 is placed on top it rests on both the corner posts 14 and the brace 160. In other words, the depth of the notches 158 should equal the vertical height (H) of the brace 160.

The wings 130, 132 of each corner post 14 are hidden under the sidewalls in the figure. The corner post tabs 110, 112 can be seen extending upwardly so that they can fit through slots 40, 42 located in a second tray 12 located over the first tray 12 to secure the trays in vertical alignment. The folded corner posts 14 engage both the tray 12 on which the corner posts 14 rest and the tray 12 above (not shown).

Preferably, the braces 160 are hollow paper tubes formed into a desired shape, such as those marketed by Sonoco Products Company of Hartsville, S.C. and described in U.S. Pat. Nos. 4,482,054; 5,593,039; 6,059,104 and 6,186,329, incorporated herein by reference. However, the braces may also be made from any suitable material, including without limitation plastic, metal or wood.

In the embodiment illustrated in FIG. 9 the brace 160 has a substantially I-shaped cross-sectional profile and comprises a pair of spaced apart side walls 168 connected at their top and bottom ends. The brace 160 is vertically oriented, that is, with each opposing side wall 168 oriented substantially in a vertical plane for maximum compression strength in the vertical direction.

Any number of product display layers can be achieved with the invention. By way of example only, and without limitation as to the scope of the invention, to assemble the a six layer packaging system 10 according to FIG. 1, the assembler—typically the product wholesaler—places a first tray 12*a*, preferably with pre-attached corner posts 14*a*, onto a standard pallet 20 (and places products onto the first tray 12*a*), and then places a diagonal brace 160*a* onto diagonally opposing corner posts as described above. Next, the vendor guides a second tray 12*b* with corner posts 14*b* onto the top of each corner post 12*a* so that the tabs 110, 112 of each corner post 12*a* extends through the slots 40, 42 in the second tray 12*b*. Products may be loaded onto the second tray 12*b*, and a second diagonal brace 160*b* guided into top notches 158 in diagonally opposing corner posts 14*b* of the second tray 12*b*. The second diagonal brace 160*b* may extend along the same diagonal as shown in FIG. 1, or along the other diagonal so that, when viewed from above, the diagonal braces cross or intersect. The later arrangement is thought to provide extra strength and system stability.

The vendor continues adding tray layers in this manner until the first five layers have been achieved. (In FIG. 1 the first four layers hold snack chip products while the fifth layer, shorter than the first four layers, holds dip containers.) The sixth and final tray 12*f* (with corner posts not shown) is placed over the relatively shorter corner posts 14'.

A top cap (not shown) may be placed over the top level of corner posts so that its side walls and end walls extend downward to help secure the top cap to the upwardly extending corner posts by fitting the corner posts snugly within the top cap side walls and end walls. The tabs 110, 122 of the topmost corner posts 14 (not shown) should extend through corner slots in the top cap. Finally, the entire assembly 10 may be wrapped in transparent plastic film to protect the products from dust and damage during shipment.

When placed on display in a retail setting a header or other sign may be mounted on a central pole which is then inserted through optional openings 162 located in the center of the bottom panels 26 (FIGS. 6A and 6B).

Packaging System—Alternative Embodiments

FIGS. 10-12 illustrate a packaging system comprising the alternative corner posts 16 made from the blank 140 of FIG. 4 and additional braces. The additional braces shown in FIGS. 10-11 are referred to as "perimeter braces" because they extend from one corner post to another, adjacent corner posts located along a perimeter (end or side) of the packaging assembly. Those perimeter braces extending between one corner post 16 and another corner post 16 along an end (front or rear) of the assembly may also be referred to as end braces 170 while those extending between one corner post and another corner post along a side of the assembly may also be referred to as side braces 172.

The corner posts 16, as noted above, include the additional perimeter notches 182 disposed in the inner walls 176 to accommodate the perimeter braces. For example, FIG. 10 shows a single layer of a packaging system including a diagonal brace 160 like that shown in FIG. 9 plus a pair of end braces 170. Each end brace 170 extends between two adjacent corner posts 16 so that it is captured (held) within the notches 182 formed in the adjacent corner posts 16 and its ends 174 extend into the hollow interior spaces of the corner posts 16. As with the diagonal brace 160, the top (upper) edge 178 of the end brace 170 should be aligned with the top edge 108' of the corner posts 16 so that if a second tray 12 is placed on top it rests on both the corner posts 16 and the end brace 170. In other words, the depth of the notches 182 should equal the vertical height of the end brace 170.

The corner posts 16 of FIG. 10 may be affixed to the tray 12 in a manner similar to that of the corner posts 14 shown in FIG. 9. That is, the wings 130, 132 of each corner post 16 may be captured by the side walls 128 and the end walls 130 as described above and shown in more detail in FIGS. 6A, 6B and 6C with respect to the previous corner post 14. The corner post tabs 110, 112 extend upwardly so that they can fit through slots 40, 42 located in a second tray 12 located over the first tray 12 to secure the trays 12 in vertical alignment. The corner posts 16 engage both the tray 12 on which the corner posts 16 rest and the tray 12 above (not shown in FIG. 10).

Still more braces may be added to the tray and post assembly as needed. For example, in the embodiment shown in FIG. 11 the tray and post assembly includes a diagonal brace 160 and two pairs of perimeter braces 170, 172. Specifically, the assembly comprises a diagonal brace 160 extending between one pair of diagonally opposite corner posts 16, a pair of end braces 170 extending between adjacent corner posts 16 along each end of the assembly, and a pair of side braces 172 extending between adjacent corner posts 16 along each side of the assembly.

With the addition of a central vertical post 185 as shown in FIG. 12, a tray and post assembly may be constructed having seven braces: one full diagonal brace 160, four perimeter braces 170, 172, and two "half diagonal braces" 186. The central vertical post 185 extends from the center of the tray bottom panel 26 to a height equal to the corner posts 16, and includes notches to accommodate the braces. Each half diagonal brace 186 extends from a corner post 16 to the central vertical post 185 so that its ends 174 extend into the hollow interior spaces of the corner post 16 and the central vertical post 185.

Thus there has been described a packaging system for shipping and displaying palletized products. The system enhances product visibility and reduces packaging waste and material costs by eliminating the need for partitions or dividers. The system is strong enough not only to support the weight of the products on the trays and withstand the vibration and impact forces that can occur during shipping, but also to withstand the weight of one or more units stacked on top. The system is particularly suited for shipping and displaying irregularly shaped items or items that cannot withstand vertical stacking forces, such as soft-packaged products, since the system can bear the entire stacking load.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A packaging system for shipping and displaying products, the packaging system comprising: a plurality of vertically stacked trays for holding the products, each tray having a bottom panel for supporting the products, two opposing side walls and two opposing end walls extending upwardly from the bottom panel;

diagonally opposed corner posts extending between vertically adjacent trays for spacing and supporting the trays, each corner post made from a single unitary blank and having a substantially rectangular cross section and comprising two orthogonal outer walls joined along an outer vertical edge, two orthogonal inner walls joined along an inner vertical edge and a substantially hollow interior, each corner post further having a top edge that supports an upper tray and a bottom edge that rests on a lower tray, each corner post further having a top notch cut out of the top edge and located along the inner vertical edge; and a separate elongated brace located under and supporting the upper tray, the brace extending diagonally between two of the diagonally opposed corner posts, the brace having opposing ends that extend through the top notches in the two diagonally opposed corner posts and into the hollow interiors of the corresponding posts, the brace directly contacting and supporting the upper tray along the brace's entire length.

2. The packaging system of claim 1 wherein each corner post further comprises at least one tab extending upwardly from the top edge of the orthogonal outer walls; and wherein the at least one tab extends through a slot disposed in the bottom panel of the upper tray.

3. The packaging system of claim 1 wherein each corner post further comprises two wings extending outwardly from a lower portion of the corner posts at a right angle to each other, wherein one wing is enclosed by one of the tray end walls and the other wing is enclosed by one of the tray side walls to secure the corner post to a tray from said plurality of trays.

4. The packaging system of claim 1 wherein a plurality of braces located under vertically adjacent trays extend along different diagonals.

5. The packaging system of claim 1 wherein another brace extends horizontally from one of the corner posts to another corner post of said corner posts along a perimeter of the packaging system.

6. The packaging system of claim 1 wherein each corner post further comprises a perimeter notch disposed in each inner wall to accommodate additional braces.

7. The packaging system of claim 1 wherein a bottommost tray is disposed on a pallet.

8. The packaging system of claim 1 wherein the trays and corner posts are formed of corrugated board and each brace is a hollow paper tube.

* * * * *